US009474322B1

(12) United States Patent
Pearson

(10) Patent No.: US 9,474,322 B1
(45) Date of Patent: Oct. 25, 2016

(54) CONVERTIBLE HIGH STYLE FOOTWEAR

(71) Applicant: Donna Maryann Pearson, Thornwood, NY (US)

(72) Inventor: Donna Maryann Pearson, Thornwood, NY (US)

( * ) Notice: Subject to any disclaimer, the term of this patent is extended or adjusted under 35 U.S.C. 154(b) by 0 days.

(21) Appl. No.: 14/941,279

(22) Filed: Nov. 13, 2015

(51) Int. Cl.
*A43B 3/24* (2006.01)
*A43B 23/20* (2006.01)
*A43B 13/36* (2006.01)
*A43B 21/52* (2006.01)

(52) U.S. Cl.
CPC ..... *A43B 3/246* (2013.01); *A43B 3/244* (2013.01); *A43B 13/36* (2013.01); *A43B 21/52* (2013.01); *A43B 23/20* (2013.01)

(58) Field of Classification Search
CPC ..... A43B 13/28; A43B 13/36; A43B 21/36; A43B 21/42; A43B 21/52; A43B 3/244
USPC ..... 36/15, 100, 101, 42
See application file for complete search history.

(56) References Cited

U.S. PATENT DOCUMENTS 1,236,350 A * 8/1917 Pougher ..... A43B 13/36 36/15
1,338,580 A * 4/1920 Morgan ..... A43B 21/37 36/42
2,195,324 A * 3/1940 Brunmark ..... A43B 21/39 36/42
2,285,738 A * 6/1942 Melchionna ..... A43B 7/144 36/34 R
2,795,866 A * 6/1957 Perugia ..... A43B 13/34 36/24.5
2,873,540 A * 2/1959 Murphy ..... A43B 3/24 36/101
3,581,413 A * 6/1971 Simonetti ..... A43B 21/47 36/42
3,977,095 A * 8/1976 Phillips ..... A43B 21/437 36/42
7,059,068 B2 * 6/2006 Magallanes ..... A43B 21/52 36/100
2003/0046829 A1 * 3/2003 Baechtold ..... A43B 5/0417 36/15
2007/0256330 A1 * 11/2007 Wallin ..... A43B 3/24 36/102
2008/0263898 A1 * 10/2008 Gueh ..... A43B 3/24 36/100
2012/0174435 A1 * 7/2012 Ruano Cerdan ..... A43B 1/0054 36/42
2013/0247413 A1 * 9/2013 Cumbus ..... A43B 21/42 36/42
2014/0033568 A1 2/2014 Pearson

* cited by examiner

*Primary Examiner* — Marie Bays
(74) *Attorney, Agent, or Firm* — Andrew S. Langsam; Pryor Cashman LLP

(57) ABSTRACT

A system and components for allowing for selective interchanging shoe uppers with shoe soles, platforms and heels by a set of interengaging metal tracks on the bottom of the upper and a mating and longitudinally slidable track on the top of the sole, the tracks having inwardly directed resilient interlocking teeth fitting into opposed gaps of the opposed track. A simple spring steel latch extending from the bottom track captured within a recess of the top track and a release button allowing for detachment is provided.

12 Claims, 16 Drawing Sheets

Figure 17
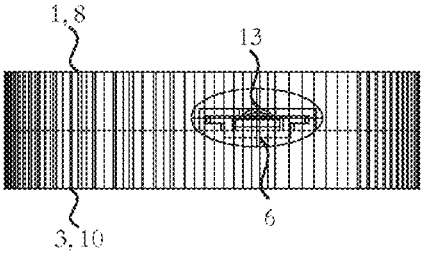
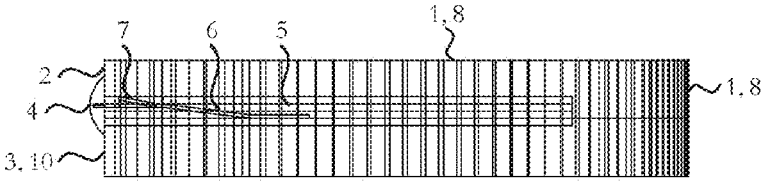
Figure 18

CONVERTIBLE HIGH STYLE FOOTWEAR

BACKGROUND OF INVENTION

The present invention relates to women's shoes and is intended to provide a shoe system for allowing women to maintain variety, comfort and confidence in their shoe selection. The present invention will provide women with greater creative freedom in purchasing a new shoe as they will be able to mix and match the uppers, insoles or tops and the bottoms, bases, or heels of their shoes. Different soles, bases, and heels can selectively attach to the uppers making a single pair of upper and lower shoe portions very versatile. The easy slide, snap-on and easy release of the mating components allow women to conveniently accessorize and customize their shoes.

Women's footwear should provide both flexibility of comfort and style. With the present invention, women will be able to easily change the height of their heels and soles when they want a more comfortable shoe and/or they can similarly change the heels and soles when they want to provide a pair of shoes intended to be more fashionable. The present invention is also desirable for women who frequently travel, whether for business or pleasure. Women will no longer have to pack a different pair of shoes for coordinating with each and every outfit brought on the trip but, rather, they will be able to pack just a few shoe uppers or bases and coordinating shoe soles & heels to create several pairs of shoes, each pair being intended to mix and match to their packed outfits—whether the apparel is worn in the day or night. She will be coordinated, when desired, and, yet, have more comfortable shoes also when desired (although the two are not, of course, mutually exclusive).

BACKGROUND OF INVENTION

The use of interchangeable soles and heels is surely present in the prior art. More specifically, interchangeable soles and heels have heretofore been devised and utilized by others. They consist basically of familiar, expected and obvious structural configurations. Notwithstanding the myriad of designs encompassed by the crowded prior art which have been developed for the fulfillment of countless objectives and requirements, the present invention is new, novel, and unique.

Known-prior art includes U.S. Pat. No. 6,651,359 B1; US Patent Publ. 2007/0266506; U.S. Pat. No. 3,204,346; US Patent Publ. 2003/192205; U.S. Pat. Nos. 6,598,318; 7,219,445; US Patent Publ. 2002/162202; U.S. Pat. Nos. 6,631,570; 5,581,910; 7,185448; 4,363,177; US Patent Publ. 2006/0053661; U.S. Pat. Nos. 4,439,935; 4,974,344; 4,839,948; US Patent Publ. 2009/0293312; and US Patent Publ. 2003/0177664.

While these devices fulfill their respective, particular objectives and requirements, the aforementioned references do not disclose a new interchangeable shoe with an easy attachable, sturdy and detachable longitudinal-extending track fastening mechanism for the sole of the shoe or an easy attachable and detachable heel system.

In this respect, the interchangeable uppers, soles and heel system and components according to the present invention substantially differs from the conventional concepts and designs of the prior art, and in so doing provides an apparatus, system and set of components which are primarily developed for the purpose of easily, quickly, and conveniently altering the height and/or decorative look of a shoe. This is believed to be highly desirable for women.

SUMMARY OF INVENTION

A new concept for shoes is set forth in the present specification. The shoe concept, system, and components comprise a do-it-yourself interchangeable platform or flat sole for wedge heel shoes and platform stiletto shoes which also have interchangeable stiletto heels. The soles are attached to uppers with coordinated stainless steel tracks on the corresponding components that longitudinally slide into one another and then interlock in place. The two components comprising an integrated shoe are held together by stainless steel and, yet, a vertically flexible leaf, spring-like latch mechanism locks and unlocks the same. The sole is detachable by manual pushing upon a release button on the back of the shoe's sole. The stiletto shoe may also be provided with an interchangeable stiletto heel by screwing and unscrewing a stainless steel screw connected onto the stiletto heel into a female receptacle/sleeve located inside of the fixed stiletto shoe base. Securement is further accomplished by a lock washer. All interchangeable parts can vary in height, shape, style and material to provide a set of complete shoes from just a few components.

BRIEF DESCRIPTION OF THE DRAWINGS

FIG. 17 is a back or rear elevational view of the fixed shoe base and interchangeable shoe sole with stainless steel tracks engaged and also showing the release or back button for the spring-leaf release;

FIG. 18 is a side and cross-sectional elevational view of the fixed shoe base and interchangeable shoe sole with stainless steel tracks engaged together and also showing the rear projection of the release button;

DETAILED DESCRIPTION OF THE INVENTION, FIGURES AND THE PREFERRED EMBODIMENT

Figure 1:
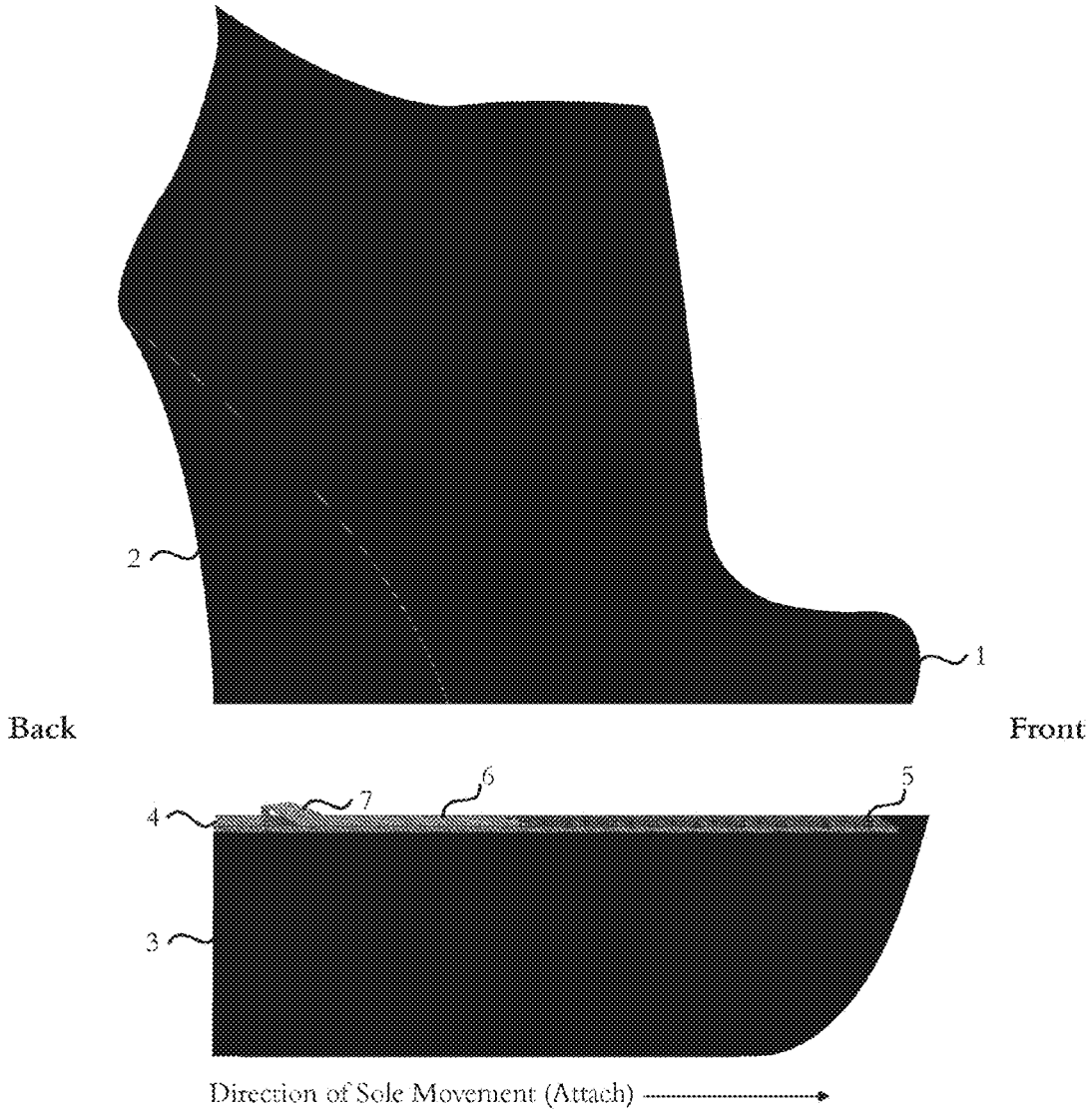
FIG. 1 is a side, exploded and elevational view of a silhouette of a representative complete wedge heel upper shoe with a fixed shoe base and an interchangeable and attachable (by relative sliding as shown in the Arrow) track of a platform sole which commercially can vary in height, shape, style and material, according to the present invention.

As best seen in the FIGS. a platform sole is provided for selectively attaching to and detaching from one or more upper shoe bases. A pair of longitudinally slidable channels, one on the upper and the coordinating channel secured to the sole is provided. A shoe-latching device is also provided, one piece to the sole and the other to the upper and is made of spring steel for resilience. A mating track is secured to the top surface of the platform sole. When the shoe base and the shoe sole are slid with respect to one another, with the outwardly resilient and extending flanges of one track sliding between the channel flanges (See FIG. 10) of the track of the sole, the resilient leaf spring on the shoe sole is first pushed downwardly until it pops up and is held in the recess 14 (see FIG. 11) of the channel of the shoe base. Then the two components, tracks of the shoe base and shoe sole, are aligned, held securely, in the front to back orientation, side to side and up and down. The shoe's sole is clamped onto the shoe's base until the two components are disengaged, accomplished by manually depressing the button 4 (see FIGS. 8, 12 and 13) which disengages (by pushing down on the resilient leaf spring-like latch) the upwardly extending component 7 from the recess or cavity 14. Then, the shoe's sole can be longitudinally slid rearwardly with respect to the front or toe of the shoe, of the shoe's upper or base. Then, the components can be physically separated and a new and different shoe sole slid and placed thereon, with or without a new heel, as required. Or, of course, the same shoe sole can be used with a new shoe upper or base.

As can be appreciated by one of ordinary skill in the art and with respect to the FIGS., a pair of parallel, spaced and outwardly extending rail flanges (See FIG. 10) is provided to a shoe sole. The channel or track mechanism 5, has a flat interconnecting or planar surface between its rails. The channel mechanism 5 is provided with central apertures (not shown) for screws to pass through to secure the channel or track mechanism to the top of a shoe sole piece (bottom of FIGS. 1 and 2). Alternatively, the channel mechanism can be secured to the shoe sole piece 3 by adhesive or other securing means. Preferred embodiments of the track 5 for the sole 3 have rails with outwardly extending flanges 19 yet with gaps or a series of evenly spaced indentations extending from one end to another and between the flanges 19.

FIG. 1 is a side view of the complete (but vertically exploded for ease of illustration) wedge heel shoe comprising an upper component, a fixed wedge heel shoe base 2. The toe end 1 and a back of the shoe base 2 are shown, along with a boot component or complete upper of aesthetic or comfortable design.

The toe end and extending backwardly are for one or more interchangeable, wedge heel shoe soles 3 (See FIGS. 1, 2, 4, 6 and 15). This sole will slide upon and be secured to shoe base 2, as desired. The channel or track mechanism of the shoe base is meant to receive and secure the channel or track mechanism of the shoe sole, when the rails and channel flanges of the shoe sole are aligned with the rails and channel flanges of the shoe base, with the toe of the sole being slid first onto the rear of the channel of the upper or base and slid past each tooth or flange until the toe of the sole is located beneath the toe of the base, and the rear portions of the upper or base are directly aligned and above the rear of the sole. In this configuration, the sole is aligned and secured to the base and a complete shoe is available for wearing. When fully slid, a latching mechanism holds the two components until they are mechanically disengaged. It is the concept of the present system that a single (or more) upper or shoe base can be provided with two or more shoe soles to provide versatility of height, fashion, material, comfort, etc. to a wearer, depending upon which sole piece or upper is secured to a shoe base or sole, respectively. Of course, several shoe bases and shoe soles provide even greater combinations of the same for even greater versatility.

The latch mechanism (see FIG. 9) is located and secured between the flanges of the channel mechanism near the rear of the shoe (secured to the planar surface between the rails or tracks between the outwardly extending flanges). It is preferably formed of spring steel of sufficient resilience that the latch can be pushed downwardly as a leaf spring, towards the sole and the channel mechanism of the sole when the sole is being connected to the base but is biased up with sufficient strength and resilience to have the upward projection element 7, raise up, when the planar surface of the channel mechanism of the shoe base is no longer present, but, rather, along its longitudinal axis, a recess or chamber 14 is provided. That chamber allows for the projection element 7 to pop up and be retained within it, to secure the channel mechanisms of the base and the sole together, aligned in three dimensions, front to back, side to side, and up and down.

To disengage the shoe base from the shoe sole, a release button 4 is provided at the free end of the up-down resilient, leaf spring latch mechanism, i.e., the end located towards the rear of the shoe sole. Basically, the latch mechanism is a length of strip spring steel, secured by a small length to the planar surface between the outwardly extending flanges of the channel mechanism 5 of the shoe sole, and, then, proceeding rearwardly, the latching mechanism has a length of an incline section which, again, proceeding rearwardly, terminates in a short length of the end of the latching mechanism. The rearwardly protruding button or projection element 7 on the latching mechanism sits on the free end of the spring steel. It should be appreciated by one of skill in the art that the relative planar elevation of the free end with projection element 7 of the latching mechanism is above that of the short length of the latching element which is secured to the planar element between the flanges of the channel mechanism. The free end with the projection thereon moves up and down—down when compressed by the channel mechanism of the shoe base and up, when the compression is counteracted provided by the free space or chamber 14, as the two channel mechanisms are slid relative to one another. The "button" on the top of the spring steel pops into the recess or cavity of the other to secure the same together. When the two are desirably disengaged, the rear bottom is depressed and the tracks can be slid with respect to one another. Pushing against the spring bias allows and disengages the button from the recess and allows the tracks to be slid with respect to one another and the shoe base removed from the shoe sole. When it is desired to disengage the shoe sole from the shoe base, the release button 4 is depressed, removing the upwardly-biased button or projection from being held within the recess or chamber 14, and the shoe sole can be moved rearwardly with respect to the shoe base, to disengage the components.

As can be seen in the FIGS., the preferably stainless steel track 5 is provided for securement to the top surface of a shoe sole. The latch mechanism 6, see FIG. 8, with button 4 attached (see FIGS. 8 and 9) is preferably secured to the channel mechanism for the shoe sole. Of course, the mating components of the latch can be switched.

Figure 9:
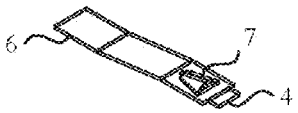
FIG. 9 is a perspective view of the resilient stainless steel latch mechanism that is secured and welded to the stainless steel track (of FIG. 10), the assembly attached to the interchangeable shoe sole.
Figure 10:
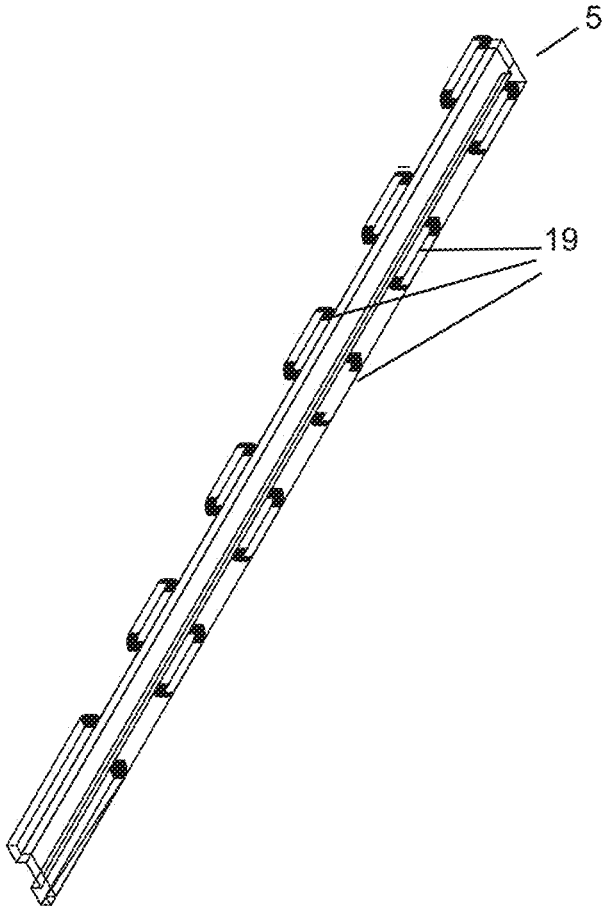
FIG. 10 is a perspective view of the stainless steel track that is attached to the interchangeable shoe sole showing springy and outwardly biased flanges or teeth projecting outwardly.
Figure 11:
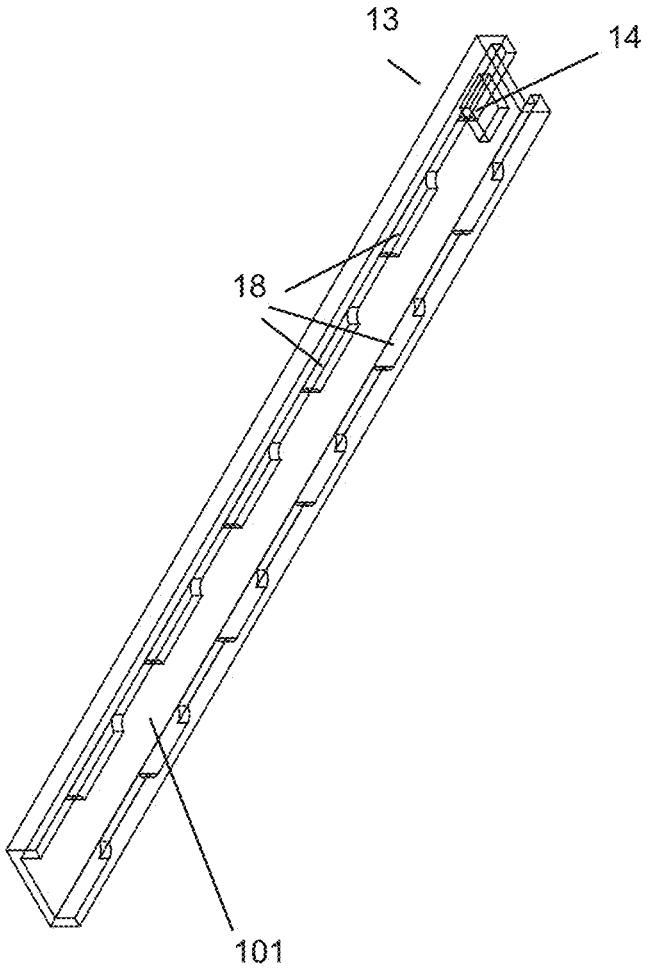
FIG. 11 is a perspective view of the stainless steel track that is attached to the fixed shoe base or upper, showing an indentation to catch the latch mechanism of the interchangeable shoe sole and corresponding inwardly directed teeth or spaced flanges for securing the track shown in FIG. 10.

The track 13 is formed with a flat ceiling 101, downwardly extending short side walls 103, and inwardly projecting flanges 18. A mating track or channel mechanism 13, see FIG. 11, is further provided for the shoe base with inwardly extending flanges or teeth 18. These interlock with mating channel 5 as shown in FIG. 10. Of course, the interchangeable shoe soles provided with the present invention and the shoe bases, can have the channel mechanisms shown in FIGS. 10 and 11 switched, too, for example, channel mechanism of FIG. 10, with the latch 6, can be provided for the shoe base and the channel or track mechanism for the shoe sole can be that shown in FIG. 11. And, in addition, according to the present invention, the channel or track members 5 and 13, shown in FIGS. 10 and 11, with the latch mechanism 6 of FIG. 9, can be selectively and easily removable and securable to the top of the shoe soles and the bottom of the shoe bases, and, not necessarily permanently affixed thereto. Thus, a single set of mating channel or track mechanisms may be all that is required for multiple shoe soles and bases, if the channel mechanisms are secured by fixed screws passing through the planar surfaces between the flanges and into the top of the sole and the bottom of the base or by another simple, removable mechanism.

The shoe sole will preferably have the channel mechanism shown in FIG. 10. The resilient or flexible stainless steel latch 6 welded to the planar section or ceiling between the outwardly extending flanges is shown in FIG. 9. The track or channel mechanism is preferably stainless steel. The latch and the upwardly extending projection 7 are preferably formed from flexible or resilient spring, stainless steel acting like a leaf spring.

Figure 2:
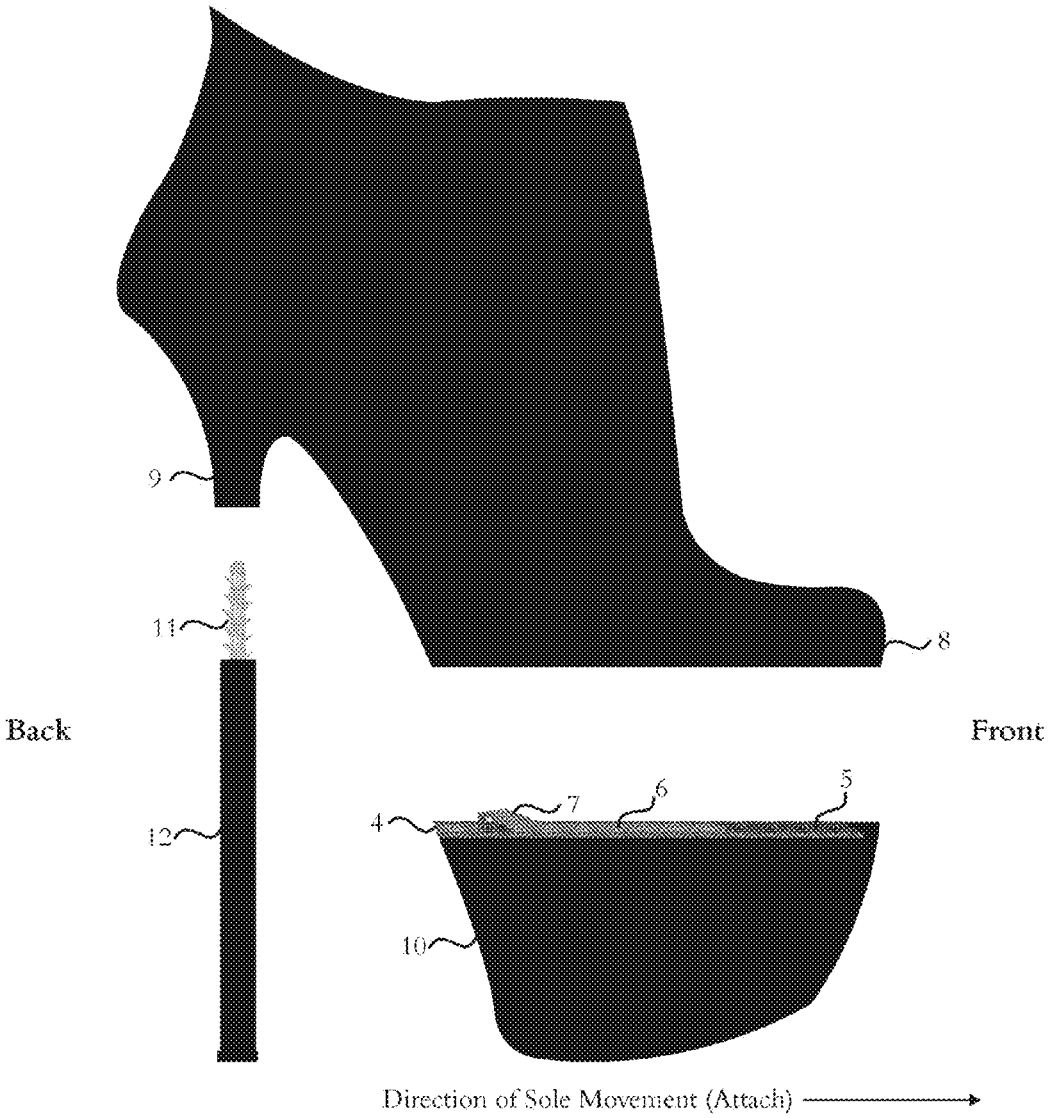
FIG. 2 is a side, exploded and elevational view of a silhouette of a complete stiletto shoe (similar to that shown in FIG. 1) with a fixed shoe base and an interchangeable platform sole, along with an interchangeable stiletto heel—both the platform base and the stiletto heel may vary in height, shape, style and material, according to the present invention.

FIG. 2 is a side view of the complete platform stiletto shoe embodiment.

A release button 4 is secured to the rear edge, the free end, of the latch mechanism 6 and projects rearwardly, with respect to the heel end of the shoe's sole and base. As the release button 4 rides up and down with the free end of the latch, it is the component which can be selectively pushed down, when desired, to free the projection 7 from the recess or chamber 14 to allow for disengagement and then relative sliding of the shoe sole from the shoe base. The leaf spring acts as a latch, holding the pieces together until the rear button is pushed down at the same time as the track of the sole is moved with respect to the track of the base.

Element 8 shows the toe or front of a fixed stiletto shoe upper or base shown in FIG. 2. In this embodiment, a female sleeve 9 or hidden bore with internal screw threads is located within the short stub 9 of the rear heel of the shoe base. It accepts (See FIG. 2) a stiletto shoe heel 12. The height of the heel 12 will correspond, of course, to that which is required for ensuring the bottom of the heel is coplanar with the bottom of the platform sole 10, shown in FIG. 2. Thus, if the platform is of minimal height, say ½ inch, then the stiletto heel 12 will only be that which will be required for the bottom of the shoe sole/platform to be coplanar with the bottom (with a rubber tip) of the stiletto heel 12. The top end of the stiletto heel 12 is provided with an upwardly extending stainless steel screw 11 which facilitates its attachment and removal into the stub 9 of the shoe base, as desired, itself provided with the female accepting screw threads therein. A locking nut can be provided, see FIG. 5, in the hidden bore, to ensure that the heel 12 is not accidentally unscrewed or removed.

Figure 3:
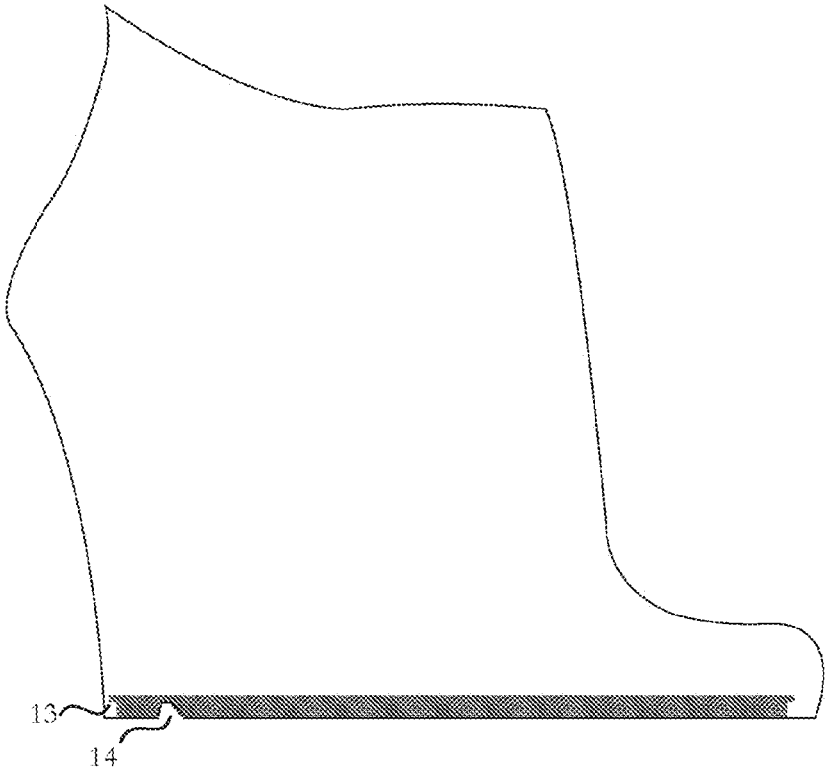
FIG. 3 is a side elevational view of the fixed wedge heel shoe base and showing the stainless steel track secured to the bottom of the same along with an indentation (described hereinafter) to catch and secure the latch of the interchangeable shoe sole (shown in FIG. 4)
Figure 5:
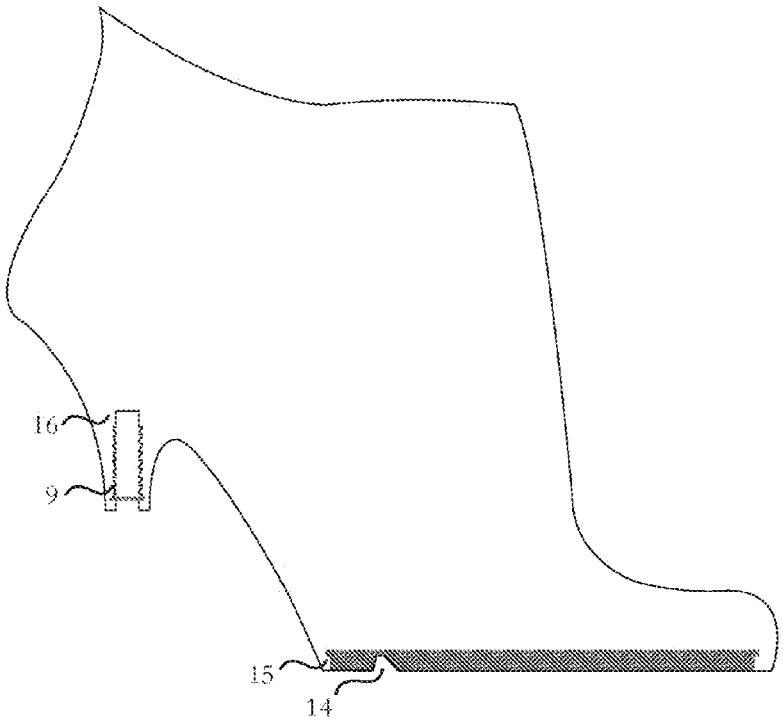
FIG. 5 is a side and cross sectional elevational view of the fixed stiletto shoe base with stainless steel track, indentation to catch and secure the latch of the interchangeable shoe sole (shown in FIG. 6) and a hidden bore or stainless steel female sleeve inside of the fixed stiletto shoe base which can receive and hold, along with a lock washer, the interchangeable stiletto heel (shown in FIG. 7)
Figure 6:
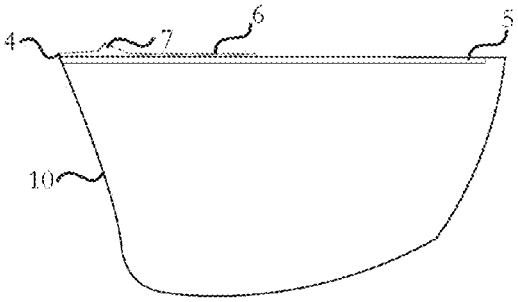
FIG. 6 is a side elevational view of the interchangeable platform shoe sole with a stainless steel track, a resilient stainless steel latch and a release button.

FIG. 3 is a side view of the fixed wedge heel shoe base or upper. As mentioned, the channel or track mechanism is secured to the bottom of the shoe base (extending from toe to heel) for mating and longitudinal coupling with the channel mechanism of any one of the shoe soles provided with the mating channel mechanism. Relative sliding is the manual action of coupling the two together, i.e., coupling of the channels or tracks of the shoe base to shoe sole. In addition, as can be seen in FIGS. 5 and 6, the bottom of the shoe base can be provided with the recess or chamber 14 for coupling with the upwardly extending projection 7 of the latching mechanism of the shoe sole. The coupling of the projection 7 of the leaf spring into and out of the recess 14 is accomplished by the up and down resilience of the spring steel of the latching mechanism.

Figure 4:
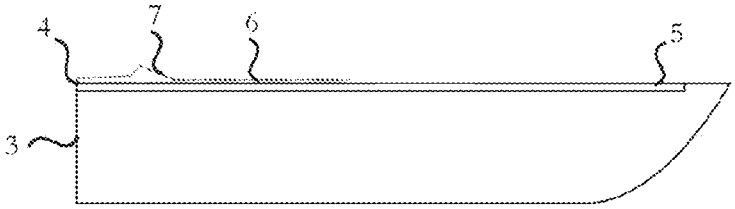
FIG. 4 is a side elevational view of the interchangeable wedge heel shoe sole provided with a stainless steel track, a resilient stainless steel latch and release button.
Figure 7:
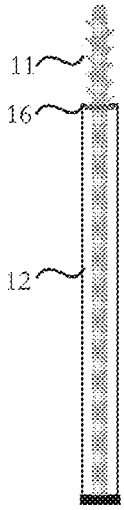
FIG. 7 is a side and cross-sectional view of an interchangeable stiletto heel with a stainless steel screw projecting upwardly to allow the heel to be screwed into and attach to the hidden bore or female, internally threaded screw sleeve inside the shoe base of FIG. 5.

FIG. 4 is a side view of an interchangeable wedge heel shoe sole 3. A vertically movable release button 4 (extending rearwardly with respect to the rear end of the sole) is provided. The latching mechanism has an upward bias of spring steel. FIG. 5 is a side view of the stiletto shoe upper or base. A hidden bore or female interiorly threaded screw sleeve 9 is provided for the stiletto shoe base for selective connecting of an interchangeable stiletto heel 12 (see FIG. 7). A stainless steel screw 11, projects from the top of the stiletto heel 12, which attaches into the heel of the stiletto shoe base by the same being received within the blind bore or screw cavity 9 of the shoe base. A locking mechanism is provided within the hidden bore 9 to capture and secure the stiletto heel 12 unless the unscrewing force exceeds a predetermined limit to unscrew and detach the same.

Figure 8:
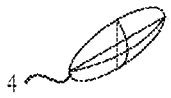
FIG. 8 is a perspective or isometric view of the release button attached to the resilient stainless steel latch.

A recess or cross-wise extending trough or chamber 14 is provided on the shoe base or the channel mechanism of the shoe base for accepting the upward projection of the channel or track mechanism of the shoe sole shown in FIG. 6. The back 15 of the channel mechanism or stainless steel track is shown on the bottom of the shoe base FIG. 6 is a side view of the interchangeable platform shoe sole. At the rear of the shoe sole, connected to the rear or free end of the latching mechanism, is a vertically movable release button 4 (see FIG. 8). The longitudinally extending channel or track mechanism for the shoe sole is shown as element 5. The resilient stainless steel latch mechanism (see FIG. 9) is shown as element 6. It will be welded on one end to stainless steel channel 5, between the outwardly flared flanges of the same (See FIG. 10). The latch mechanism is formed from flexible or resilient, spring-like i.e., leaf spring-like stainless steel. FIG. 8 is a perspective view of the release button 4. FIG. 9 is a perspective view of the flexible or resilient stainless steel latch 6, with short, forward flat section welded to the flow of channel or track mechanism between the flanges and having a ramp section and a free end with upwardly extending projection 7 thereon.

FIG. 10 is a perspective view of the stainless steel channel or track mechanism 5 with outwardly projecting flanges and connecting central planar or floor surface with springy, outwardly biased teeth that attach near to the top surface of the track. These flanges or teeth 19 are slightly inwardly compressible and allow the other track on the upper to slide past the flange. The outward bias will spring back and out between the gaps of the inwardly directed teeth or flanges of the other track.

Figure 12:
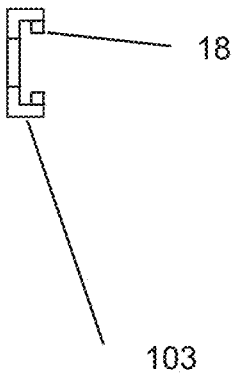
FIG. 12 is a cross section view of the track of FIG. 11 showing the downwardly and inwardly directed flanges or walls of a section of track.
Figure 13:
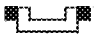
FIG. 13 is cross sectional view of the track of FIG. 10, showing the outwardly directed flanges or walls and the teeth jutting out from the channel.

FIG. 11 is a perspective view of the stainless steel track or channel mechanism 13 that attaches to the shoe upper or base with inwardly directed teeth or separated flanges 18 which alternate in longitudinal location with the teeth or flanges 19 of the other track. The flanges 18 extend into the opposed gaps of the other track for a more secure and stable connection between the shoe and the interchangeable sole. The teeth or flanges on the side walls of the channel 13 are also somewhat resilient so that when channel 13 is slid over channel 5, the side walls of the flanges or teeth of track or channel 13 may give and then expand outward to fit into the gaps of opposed channel 10. Similarly, it is noticeable in FIGS. 10 and 11 that flanges 18 and 19 have either chamfered, rounded or angled corners and side edges. This enables each flange 18 to easily slide down channel 5, in between each flange 19 until the user secures the heel in place. The projection 7 of the latching mechanism 6 will be captured by the recess or indentation 14 of the channel mechanism of the shoe base. It will be appreciated that the release button 4 can be selectively pushed down, when the shoe base is connected to the shoe sole, with the projection within the recess, and, then, overcoming the upward spring bias the channel components can be slid relative to one another to release the same, for removal of the shoe sole from that shoe base. Pushing down on the release button causes the projection to move down on the free end (which is suspended above the plane of the part of the latch mechanism welded to the planar surface of the channel mechanism). This releases the projection from contact with the recess so that relative sliding removal (toe to heel or vice versa) can be accomplished. FIG. 12 is a cross section view of one track or channel 13 showing the inwardly directed rails having flanges also inwardly directed. FIG. 13 is cross sectional view of channel 5 showing the outwardly directed rails and the outwardly directed spring flanges. The channel mechanism for the shoe base (FIG. 11) has inwardly directed rails or flanges which act as support and guiding and gliding surfaces for the outwardly directed rails and flanges of the channel member of the shoe sole (FIG. 10). FIGS. 10 and 11 illustrate that the distance between the edges of the teeth of the outwardly directed flanges of FIG. 10 are about the distance of the edges of the gaps between flanges of the channel mechanism of that shown in FIG. 11. The flanges, springiness of the teeth, spacing and location of gaps cooperate to allow the channel members to slide and glide longitudinally one upon the other and to stay in alignment so that the shoe base and shoe sole can be easily, quickly securely and conveniently assembled together and pulled apart, as desired.

Figure 14:
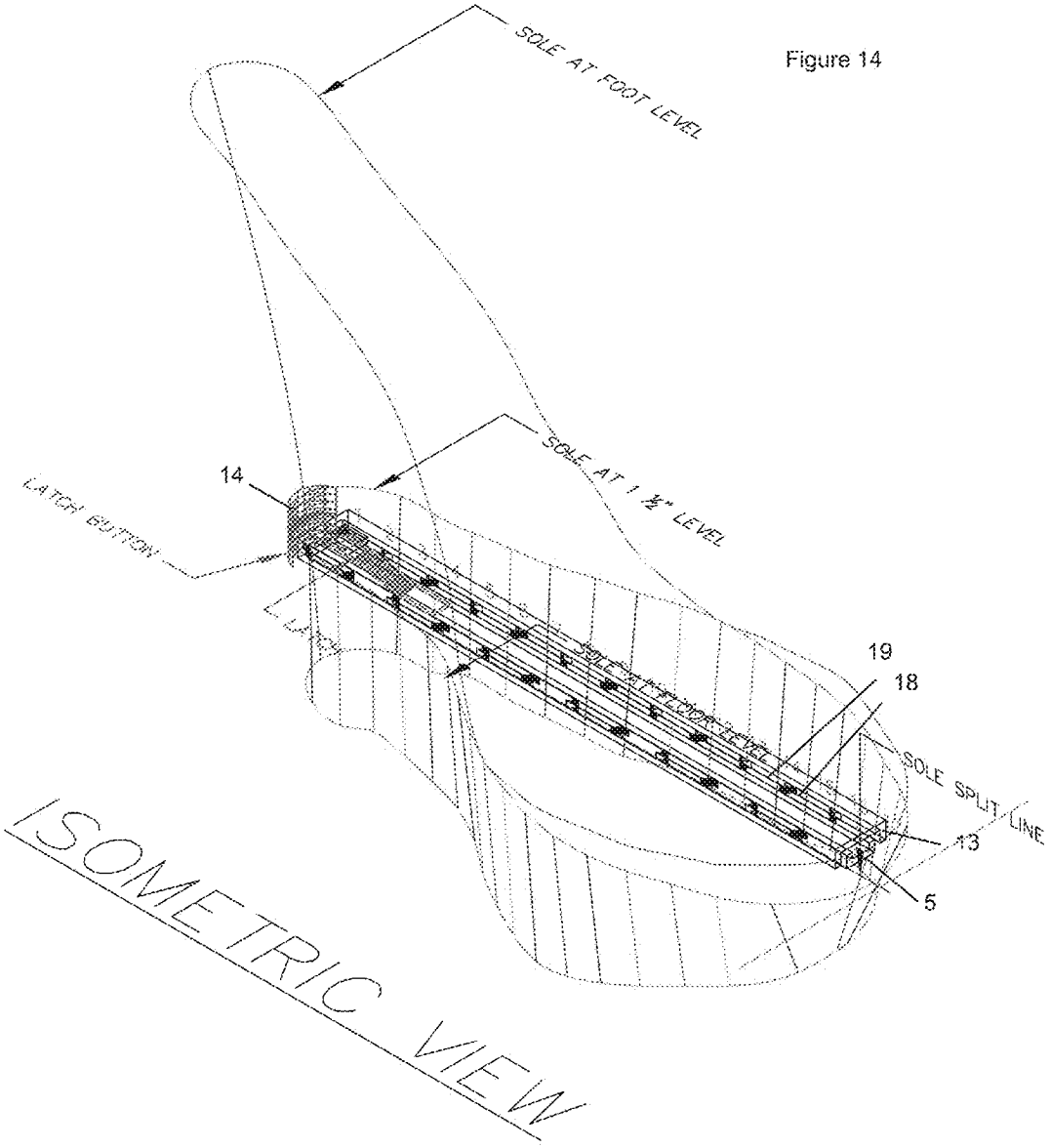
FIG. 14 is an isometric view of the fixed wedge heel shoe base or upper with the channel of the shoe sole slid within the track or channel of the shoe base or upper, i.e., with the flanges of the upper track fitting into the spaces provided between spaced flanges of the lower track.
Figure 15:
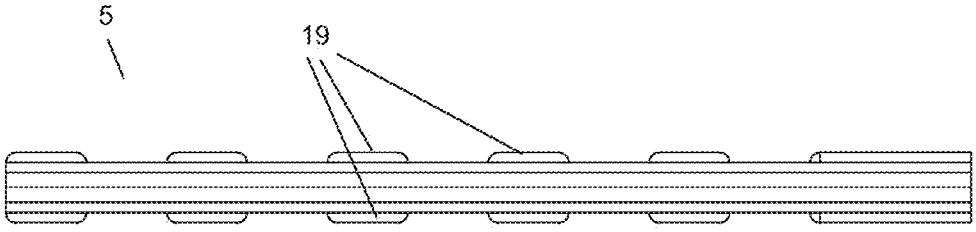
FIG. 15 is a top view of the track attached to the interchangeable sole showing the outwardly projecting and spring steel-like flanges or spaced teeth.
Figure 16:
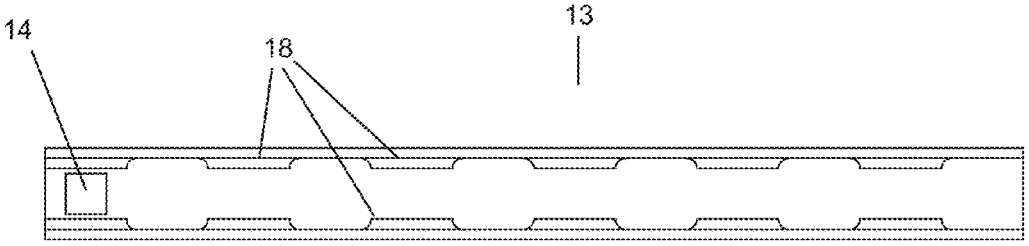
FIG. 16 is a top view of the sole track shown in FIG. 11 attached to the fixed shoe base showing the inwardly projecting flanges and spaced gaps between the same.
Figure 19:
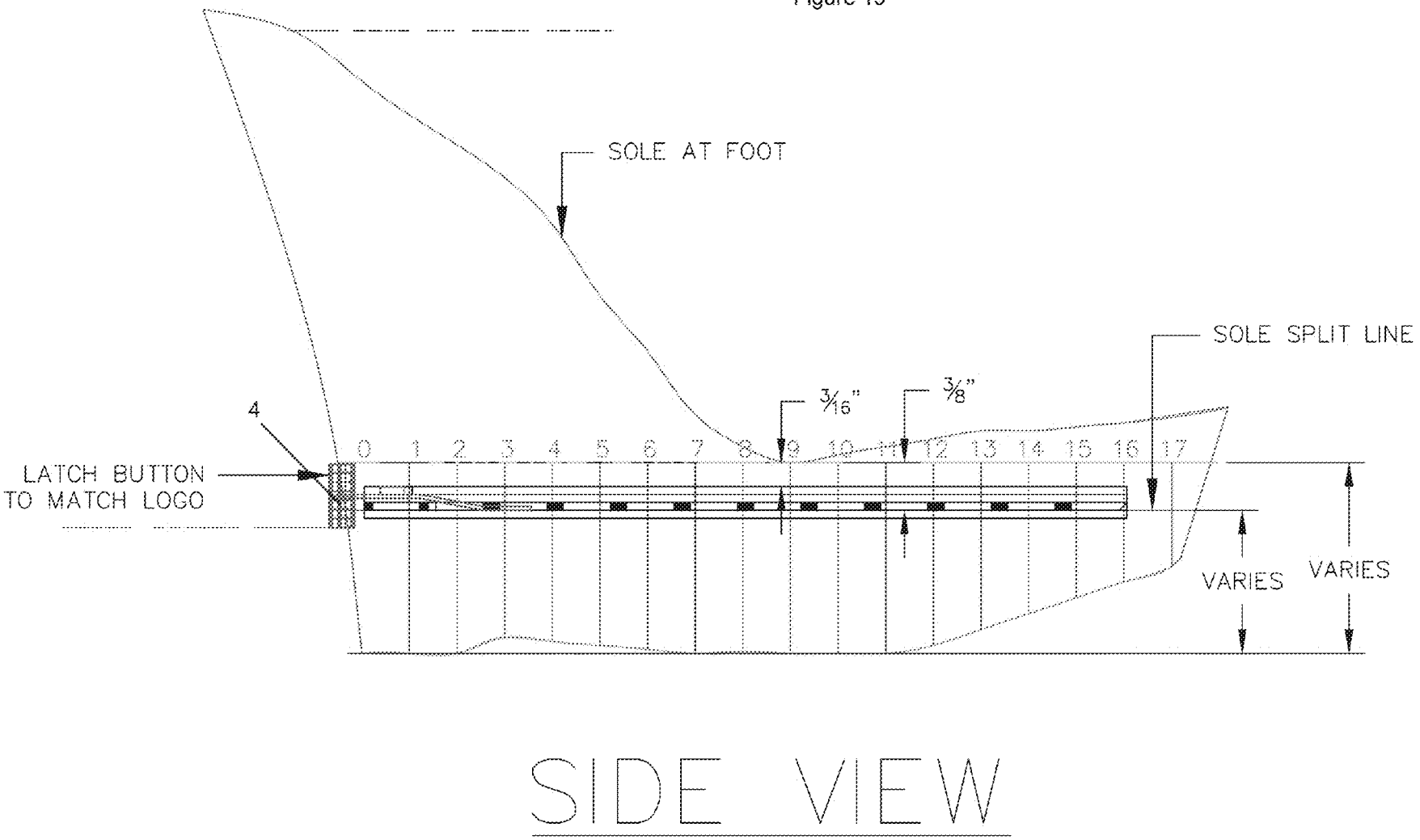
FIG. 19 is a side perspective and cross-sectional view of the engaged tracks or channel of the fixed shoe base and interchangeable shoe sole and shows the stainless steel tracks and flanges and gaps interlocked and the rear projection of the release button.
Figure 20:
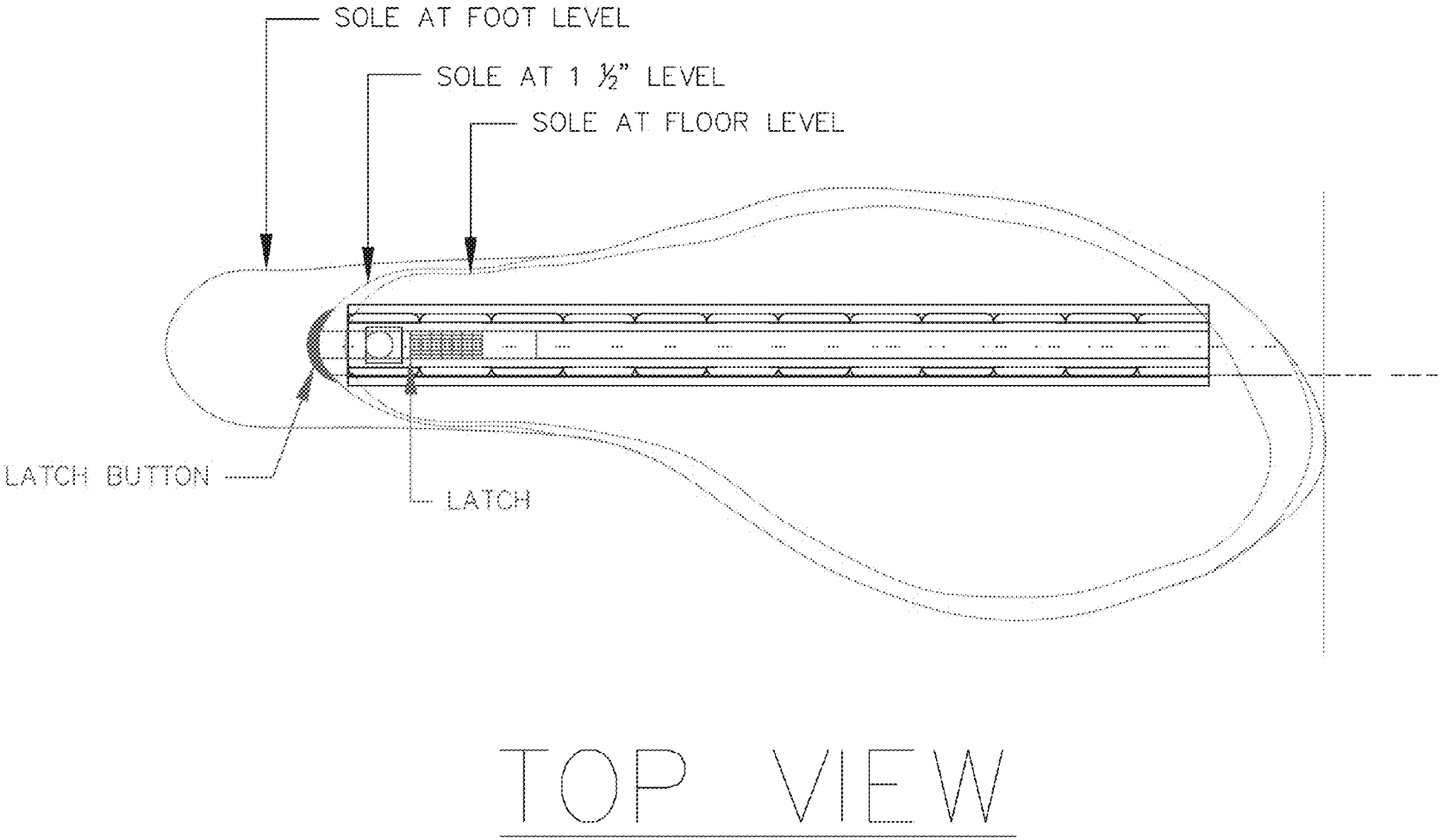
FIG. 20 is a top view of the channel or track of the shoe base or upper and interchangeable shoe sole and shows the stainless steel tracks and flanges and gaps along with the release button.
Figure 21:
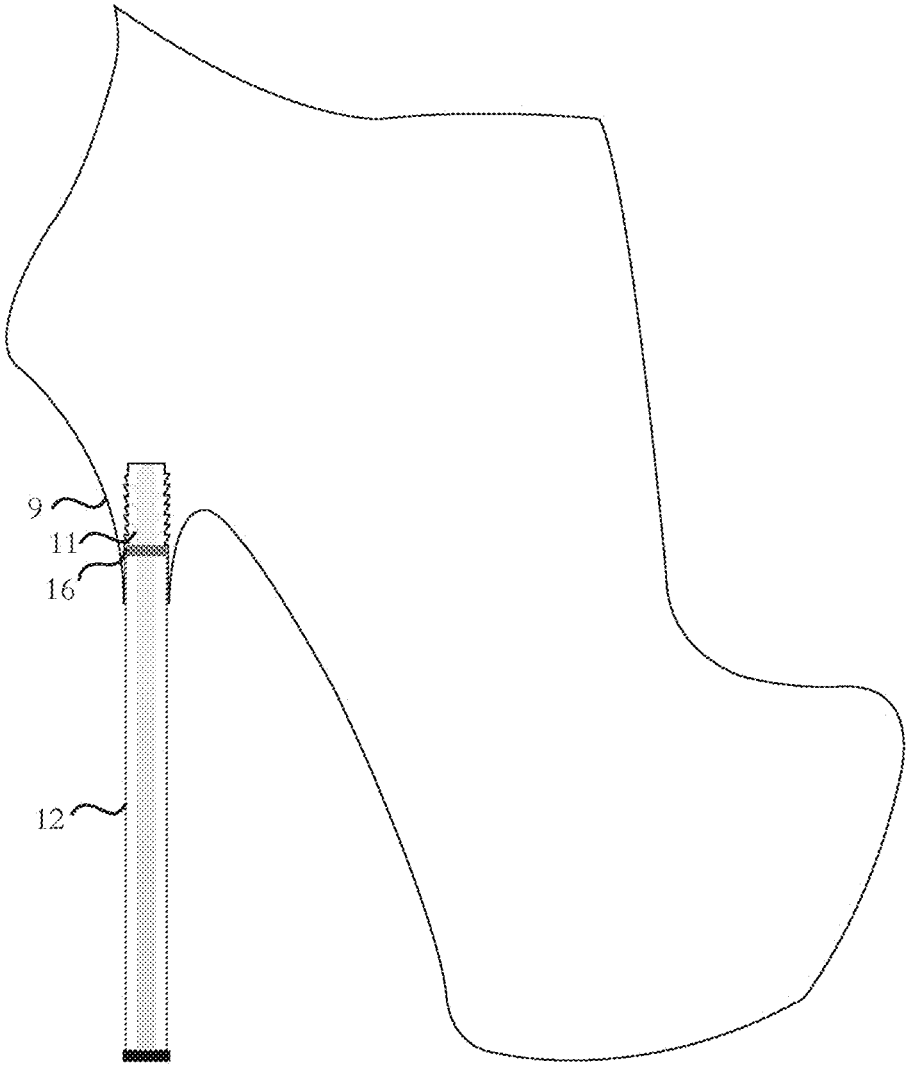
FIG. 21 is a side cross sectional view of the interchangeable stiletto heel connected to the fixed stiletto shoe base.

FIG. 14 is a shadow and isometric view of the fixed wedge heel shoe upper or base with the channel or track mechanism attached. The chamber or recess is proximal the rear or heel end of the shoe base. The flanges or teeth 18 and 19 are interlocked i.e., the teeth fit within the corresponding and opposed gaps of the other track. FIG. 15 is a top view of the channel or track of the shoe sole spaced flanges or teeth. It will be appreciated that the projection 7 will be captured by the chamber or recess 14, when the tracks and then flanges are lined up of the channel mechanisms of the shoe sole and shoe base, respectively, and the two components are longitudinally slid together. FIG. 18 is a side view of the tracks of the shoe base and interchangeable shoe sole attached to each other and with the projection 6 captured by the chamber or recess 14. FIG. 19 is a partial side view of the shoe base and interchangeable shoe sole attached to each other. The release button 4 can be seen. FIG. 21 is a side view of the interchangeable stiletto heel connected to the fixed stiletto shoe upper or base. The female or screw threaded receptive sleeve 9 of stiletto shoe base is shown with the upwardly extending screw of the stiletto heel 12, also shown as connected to sleeve 9.

The invention claimed is:

1. A system for providing an interchangeable shoe base and a shoe sole, said shoe base having an upper, foot-holding section and a substantially flat-bottom planar surface, said shoe sole having a floor-engaging bottom surface and a substantially flat top surface, said shoe base and said shoe sole integrating to form a complete wearable shoe comprising:

a first channel mechanism longitudinally and axially secured to said flat bottom surface of said shoe base, said channel mechanism having a pair of inwardly extending rails forming a sliding track and located a small distance from said flat bottom surface, said rails having resilient inwardly directed spring-like flanges with spaced gaps projecting inwardly;

a second channel mechanism longitudinally and axially secured to said flat top surface of said shoe sole, said second channel mechanism having a pair of outwardly directed rails which slidingly mate with said inwardly extending rails of said shoe base, said rails of said channel of said shoe sole having outwardly spaced teeth and able to interlock and connect with the resilient flanges of said first channel mechanism, said first and said second channel mechanisms being provided with a mechanically interlocking leaf spring latching mechanism for mechanically coupling the same when said first and said second channel mechanisms are slidingly mated with one another; and a release mechanism for selectively releasing said channel mechanism from one another by acting against a spring bias to allow sliding disengagement of said shoe sole from said shoe base.

2. A system as claimed in claim 1 wherein said shoe base is provided with a heel stub and said system further includes a stiletto heel for mechanical engagement with said heel stub.

3. A system as claimed in claim 2 wherein said heel stub and said stiletto heel are mechanically coupled to one another by a screw on either said heel stub or said stiletto heel and an interiorly threaded screw receptacle on the other of said heel stub or said stiletto heel.

4. A system as claimed in claim 1 wherein said latching mechanism comprises a spring mounted, upwardly biased protrusion on either said first or said second channel mechanism and the other of said first or second channel mechanism provided with a capture recess for said protrusion.

5. A system as claimed in claim 4 further comprising a vertically depressible release button on either said first or said second channel mechanism for disengaging said protrusion from said recess.

6. A system as claimed in claim 1 wherein said latching mechanism comprises a resilient, spring steel member secured to either said first or said second channel mechanism and said spring steel member is biased away from said channel mechanism to which it is secure.

7. A system as claimed in claim 1 wherein said release mechanism is located proximal to the back of said shoe.

8. A system as claimed in claim 2 wherein said stiletto heel is of a length such that when connected to said heel stub the base of said stiletto heel is substantially co-planar with the bottom surface of said shoe sole.

9. A system as claimed in claim 1 wherein said projecting flanges of said rails are chamfered.

10. A system as claimed in claim 1 wherein said flat top and/or bottom surfaces of said channel mechanisms are glued or otherwise adhered to the planar surface of said shoe base and/or the bottom surface of said shoe sole, respectively.

11. A system as claimed in claim 4 wherein said latching mechanism is provided with a release button secured to a free end for moving said free end and said protrusion out of engagement with said capture recess.

12. A system as claimed in claim 1, wherein said flanges are inwardly resilient and spaced to provide longitudinal gaps between said flanges of said first channel mechanism which gaps are filled by flanges of said second channel mechanism.

* * * * *